US006635995B1

(12) United States Patent
Blye et al.

(10) Patent No.: US 6,635,995 B1
(45) Date of Patent: Oct. 21, 2003

(54) FLUORESCENT BULB WITH IMPACT-ABSORBING SLEEVE

(75) Inventors: Bruce A. Blye, Huntington Beach; James M. Galvez, San Dimas, both of CA (US)

(73) Assignee: National Electric Mfg. Corp., Commerce, CA (US)

( * ) Notice: Subject to any disclaimer, the term of this patent is extended or adjusted under 35 U.S.C. 154(b) by 0 days.

(21) Appl. No.: 09/684,944

(22) Filed: Oct. 10, 2000

(51) Int. Cl.[7] ..... H01J 7/44

(52) U.S. Cl. ..... 315/56; 315/71; 313/50; 313/292

(58) Field of Search ..... 315/56, 58, 71; 313/49, 50, 51, 269, 292; 361/629, 631, 643, 647

(56) References Cited

U.S. PATENT DOCUMENTS

| | | | | | |
|---|---|---|---|---|---|
| 4,258,287 | A | * | 3/1981 | Hetzel | 315/58 |
| 4,316,120 | A | * | 2/1982 | Cotman et al. | 315/58 |
| 4,392,076 | A | * | 7/1983 | Ishler et al. | 313/318 |
| 4,862,035 | A | * | 8/1989 | Cunliffe et al. | 315/58 |
| 5,765,941 | A | | 6/1998 | Vest | |

* cited by examiner

*Primary Examiner*—Don Wong
*Assistant Examiner*—Thuy Vinh Tran
(74) *Attorney, Agent, or Firm*—Edgar W. Averill, Jr.

(57) ABSTRACT

An improved fluorescent bulb for use in a work lamp for rough service applications. The fluorescent bulb is of the type having a fluorescent tube which emits light when energized by electric power. A base portion connects to the fluorescent tube and encloses a base cavity which supports a starter switch bulb electrically connected to the fluorescent tube. The starter switch bulb is protectively surrounded by a preferably woven glass-fabric sleeve which absorbs impacts caused by relative movement of components within the base cavity, including the starter switch bulb itself.

4 Claims, 1 Drawing Sheet

FLUORESCENT BULB WITH IMPACT-ABSORBING SLEEVE

BACKGROUND OF THE INVENTION

The field of the invention generally pertains to light bulbs and lamps. The invention relates more particularly to a fluorescent bulb having a prophylactic sleeve surrounding a starter switch bulb which produces an electric discharge arc for initiating delivery of electric power through a fluorescent tube. The prophylactic sleeve helps reinforce and prevent the fluorescent bulb from breaking or otherwise malfunctioning when used with a work lamp in rough service applications.

Work lamps and shop lights have been developed for rough and rugged use by automotive mechanics, plumbers, technicians, etc. to durably and reliably light work areas. They commonly utilize fluorescent bulbs which must be sufficiently protected from impacts and other harsh jarring conditions which may cause the bulb to break or otherwise malfunction. Fluorescent bulbs typically include a light-emitting glass-tube connected to a base portion supporting a starter circuit. And the starter circuit typically comprises a heat sensitive switch encased in a secondary glass starter bulb.

Because the starter circuit functions to initially energize ionizable gas contained in the glass-tube for producing visible light, it is particularly important to keep it sheltered from harm. It is known, however, that the starter circuit, and particularly the glass starter bulb, is vulnerable to breakage or other damage from impacts caused by the relative movement of components disposed within the base portion, including the starter bulb. For example, because the starter bulb is typically suspended in the base portion only by flimsy wire conduits, the starter bulb may move and strike the inner surface of the base portion when subject to an impact. This vulnerability is aggravated when subject to rough service conditions of a demanding work environment.

Various measures have been developed to make fluorescent bulbs more durable by protecting, and thereby ensuring the proper operation of, the starter switch bulb. For example, in U.S. Pat. No. 5,675,941, a fluorescent lamp is disclosed having a hole along a base portion, through which an electrically and mechanically insulating material 150 is injected. As can be seen in FIG. 4', the insulating material contacts a top portion of the glow starter switch, a portion of the fluorescent tube which extends into the base, and optionally a capacitor.

The arrangement of the '941 patent, however, may allow a substantial portion of the starter bulb to be left exposed and unprotected (see FIG. 4'). Especially where moveable components are similarly disposed within the base of the fluorescent bulb, impacting contact with the starter bulb may be possible. Furthermore, notwithstanding the flexible nature of the injected compound, the cantilevered support arrangement at the top end of the starter bulb, as shown in FIG. 4', may produce localized stresses in the starter bulb when, for example, the work lamp (and the fluorescent bulb) falls and strikes the floor in a lateral manner.

In summary, therefore, there is a need to provide a means for absorbing impacts against the starter bulb arising from the relative movement of components within the base cavity of a fluorescent bulb. In particular, padded protection of the sides of a starter bulb to impart a cushioning effect would be particularly advantageous due to the lateral direction of most impacts.

BRIEF SUMMARY OF THE INVENTION

It is therefore an object of the present invention to provide an improved fluorescent bulb having a protective sleeve surrounding a starter switch bulb, wherein the protective sleeve is adapted to absorb impacts caused by relative movements of components held within a base portion of a fluorescent bulb, including the starter switch bulb.

The present invention is for an improved fluorescent bulb for use in a work lamp for rough service applications. The prior art fluorescent bulb is of a type having a fluorescent tube adapted to emit light when energized by electric power. The fluorescent tube is connected to a base portion having a base cavity, and a starter switch bulb is supported within the base cavity. The starter switch bulb is adapted to produce an electric arc for initiating delivery of electric power through the fluorescent tube. Additionally, the improved fluorescent bulb has a prophylactic sleeve surrounding the starter switch bulb, which is adapted to absorb impacts due to relative movements of components disposed within the base cavity, especially during rough service applications.

DESCRIPTION OF THE PREFERRED EMBODIMENTS

Figure 1:
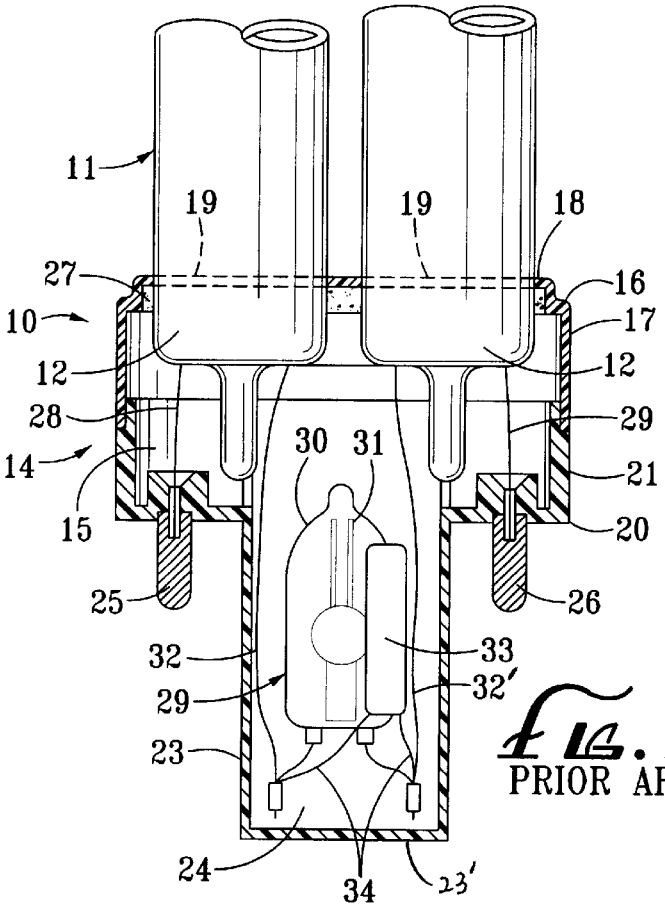
FIG. 1 PRIOR ART
FIG. 1 is partly cross-sectional view of the base end of the fluorescent bulb.

Referring now to the drawings, FIG. 1 shows a prior art fluorescent bulb, generally indicated at reference character 10. It is known to use such fluorescent bulbs 10 in portable work lamps and shop lights (not shown) commonly employed by automobile mechanics, plumbers, etc. for rough service applications. The prior art design has a fluorescent tube, generally indicated at reference character 11, and preferably has a glass construction. Moreover, the fluorescent tube 11 preferably has a U-shaped configuration (not shown) with a first end 12 and a second end 13 secured to a base, generally indicated at reference character 14. The tube 11 is of the type having an evacuated interior into which an ionizable gas is injected, such as mercury vapor. The inner surface of the tube 11 is typically coated with a phosphorous layer by which visible light is converted from ultra-violet rays produced by ionizing mercury vapor.

As shown in FIG. 1, the base 14 has an upper base portion 16 with an upper base sidewall 17 and an upper deck 18 extending transversely from the upper base sidewall 17. The upper base portion 16 is preferably constructed of a rigid metallic material, such as aluminum, but is not limited only to such. The two tube ends 12, 13 extend into a pair of holes 19 located on the upper deck 18, and are preferably rigidly affixed to the upper base portion 16 with an adhesive 27. The upper base portion 16 is connected to a lower base portion 20 preferably constructed of a rigid polymeric material. The lower base portion 20 has a lower base sidewall 21, a switch cavity sidewall 23, and a lower deck 22 transversely connecting the lower base sidewall 21 with the switch cavity sidewall 23. The switch cavity sidewall 23, together with a lower endwall 23', encloses a switch cavity 24 which houses a starter circuit (see discussion below). The upper base portion 16 and the lower base portion 20 together enclose a base cavity 15 which includes, and is continuous with, the starter switch cavity 24. As shown in FIG. 1, the tube ends 12,13 extend partially into the base cavity 15. Along the lower deck 22 of the lower base portion 20, a pair of electrical metal contacts 25 and 26 are externally mounted for connection to electrodes of an electric power source (not shown). As shown in FIG. 1, the first contact 25 connects to the left tube end 12 by means of an electrical wire conduit 28. Likewise, the second contact 26 is electrically connected to the right tube end 13 by means of an electrical wire conduit 29. More particularly, the electrical wire conduits 28 and 29 extend into the evacuated interior of the respective left 12 and right 13 tube ends and connect to filaments (not shown) which are heated during ignition of the fluorescent tube 11.

Figure 3:
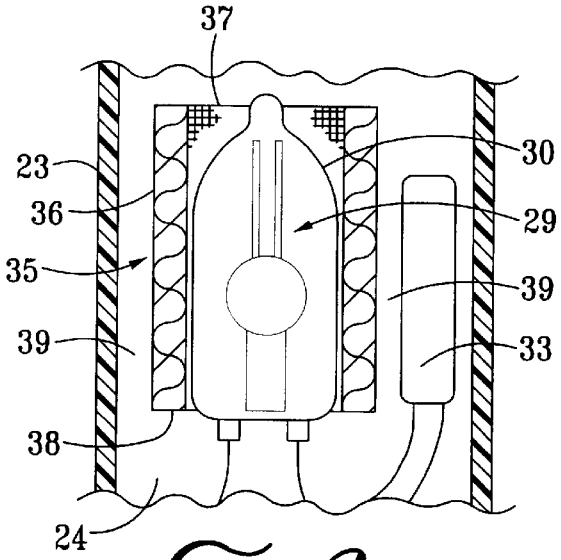
FIG. 3 is a partly cross-sectional view of the prophylactic sleeve surrounding the starter switch bulb only.
Figure 4:
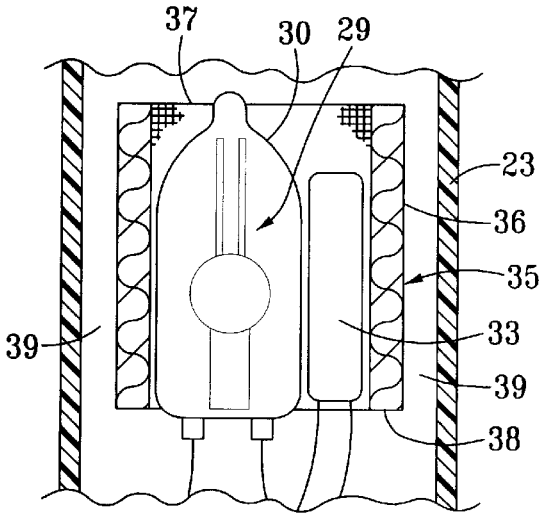
FIG. 4 shows a partly cross-sectional view of the prophylactic sleeve surrounding both the starter switch bulb and the capacitor together.

A starter circuit is shown in FIGS. 1, 3, and 4 positioned within the switch cavity 24 formed by the switch cavity sidewall 23 and the lower endwall 23'. The starter switch circuit comprises a starter switch bulb 29, preferably having a glass shell 30 and heat-sensitive contacts 31. The starter switch bulb 29 is electrically connected to the filaments of the respective left and right tube ends 12, 13 by means of electrically conducting starter wires 32 and 32'. Moreover, a capacitor 33 may be electrically connected in parallel with the starter switch bulb 29 as a radio frequency suppression device. The capacitor 33 is connected in parallel to the starter switch bulb via capacitor wires 34. With this arrangement, the starter circuit operates to produce an electric arc in a manner known in the industry, which ignites the mercury vapor contained within the fluorescent tube 11 to produce ultra-violet light. The ultra-violet light is then converted by the phosphorous coating in the tube 11 to produce visible light. Once ignited by the starter circuit, gas ionization and light emission continues while electric power is supplied by the electric power source via the electrical contacts 25, 26.

Figure 2:
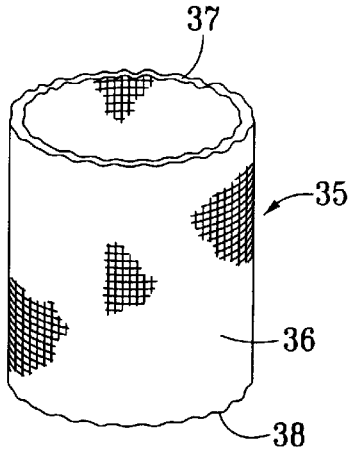
FIG. 2 shows a perspective view of the prophylactic sleeve alone.

FIG. 2 shows an improvement upon the fluorescent bulb 10 shown in FIG. 1. The improvement comprises a prophylactic sleeve, generally indicated at reference character 35, which protectively surrounds the glass shell 30 of the starter switch bulb 29. The sleeve 35 is particularly adapted to absorb impacts directed against the starter switch bulb 29, and thereby provide a cushioning effect against damage or breakage. The prophylactic sleeve 35 preferably has a generally cylindrical configuration with a cylindrical sidewall 36, an open upper end 37, and an open lower end 38. It is appreciated however, that the upper and lower ends 37, 38 may be opened or closed since it is estimated that the vast majority of impacts are directed laterally against and absorbed by the cylindrical sidewall 36. The prophylactic 35 is preferably composed of a woven glass-fabric material, which is both heat resistant and provides electrical and mechanical insulation.

FIG. 3 shows a cross-sectional view of a portion of the switch cavity 24, incorporating the prophylactic sleeve 35 of FIG. 2. As can be seen in FIG. 3, the sleeve 35 preferably surrounds the starter switch bulb 29, with the capacitor 33 located ulterior to the sleeve 35. Alternatively, as can be seen in FIG. 4, the sleeve 35 may surround both the starter switch bulb 29 and the capacitor 33 together to provide combined protection from impacts. Furthermore, it is preferred that the sleeve 35 surround the starter switch bulb 29 in a snug manner enabling movement together as a single unit. However, a marginal clearance between the sleeve 35 and the glass-shell 30 of the starter switch bulb 29 is also contemplated.

In any case, the sleeve 35 operates to absorb impacts against the starter switch bulb 29 caused by the relative movements of components in the base cavity 15, such as the starter switch bulb 29 and the capacitor 33. Relative movements are possible due to the flexible wire-suspended arrangement of those components in the base cavity 15. It is notable that, unlike the injected compound in the '941 patent, the prophylactic sleeve 35 does not contact, stabilize, or fixedly secure the starter circuit components to the tube ends 12 or 13. Rather the effects of relative movement of the components within the base 14 during rough service is ameliorated by absorbing the impacts experienced during use in rough service applications. It is appreciated that by utilizing the sleeve 35 to protectively surround the starter switch bulb 29 (and optionally the capacitor 33), this arrangement provides greater uniform coverage around the body of the starter switch bulb 29 without exposing any part and leaving it vulnerable to impacting contact. Moreover, the uniform coverage of the starter bulb provided by the sleeve 35 may prevent localized stresses from forming in the glass-shell 30 of the starter switch bulb 29, unlike a cantilever attachment at one end of the starter switch bulb.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved fluorescent bulb for use in a work lamp for rough service applications, said fluorescent bulb being of the type having a fluorescent tube adapted to emit light when energized by electric power, a base portion connected to said fluorescent tube and enclosing a base cavity, and a starter switch bulb supported within said base cavity, said starter switch bulb adapted to produce an electric arc for initiating delivery of electric power through said fluorescent tube, the improvement comprising:

a prophylactic sleeve positioned within said base cavity surrounding said starter switch bulb and adapted to absorb impacts due to the relative movements of components disposed within said base cavity, especially during rough service applications.

2. The improved fluorescent bulb as in claim 1, wherein said prophylactic sleeve additionally surrounds a capacitor electrically connected to said starter switch bulb, for minimizing relative movement between said starter switch bulb and said capacitor.

3. The improved fluorescent bulb as in claim 1, wherein said prophylactic sleeve is composed of a woven glass-fabric material.

4. The improved fluorescent bulb as in claim 1, wherein said prophylactic sleeve snugly contacts said starter switch bulb and said base portion, whereby said starter switch bulb is immobilized relative to said base portion.

* * * * *